US006494515B1

(12) United States Patent
Kalbfleisch

(10) Patent No.: US 6,494,515 B1
(45) Date of Patent: Dec. 17, 2002

(54) POLE HANDLER ATTACHMENT

(76) Inventor: Carl D. Kalbfleisch, 8575 Clear Lake Rd., Brown City, MI (US) 48416

( * ) Notice: Subject to any disclaimer, the term of this patent is extended or adjusted under 35 U.S.C. 154(b) by 0 days.

(21) Appl. No.: 10/038,726

(22) Filed: Jan. 2, 2002

(51) Int. Cl.[7] ..... B66C 1/44

(52) U.S. Cl. ..... 294/86.41; 294/88; 294/104; 414/23; 414/732; 414/740

(58) Field of Search ..... 294/67.22, 86.41, 294/88, 104, 106; 414/23, 731, 732, 735, 738–740, 743, 745.1, 783

(56) References Cited

U.S. PATENT DOCUMENTS

| | | | | | |
|---|---|---|---|---|---|
| 2,831,589 | A | * | 4/1958 | Way | 294/86.41 X |
| 3,112,830 | A | * | 12/1963 | Podlesak | 294/86.41 X |
| 3,204,795 | A | | 9/1965 | Larson | |
| 3,263,834 | A | | 8/1966 | La Tendresse | |
| 3,327,879 | A | | 6/1967 | Lull | |
| 3,631,995 | A | | 1/1972 | Jones | |
| 3,651,966 | A | * | 3/1972 | Willett | 294/86.41 X |
| 3,817,567 | A | | 6/1974 | Lull | |
| 4,030,746 | A | * | 6/1977 | Langowski | 294/86.41 X |
| 4,280,785 | A | | 7/1981 | Albrecht | |
| 4,362,435 | A | * | 12/1982 | Henry | 294/104 X |
| 4,451,194 | A | | 5/1984 | Keats et al. | |
| 4,775,276 | A | | 10/1988 | McMillan | |
| 5,073,080 | A | * | 12/1991 | Blum | 294/86.41 X |
| 5,141,387 | A | | 8/1992 | Smith | |
| 5,219,265 | A | | 6/1993 | Recker | |
| 5,328,223 | A | | 7/1994 | Maggio | |
| 5,516,174 | A | * | 5/1996 | Squyres | 294/86.41 |

* cited by examiner

*Primary Examiner*—Johnny D. Cherry
(74) *Attorney, Agent, or Firm*—Reising, Ethington, Barnes, Kisselle, Learman & McCulloch, PC

(57) ABSTRACT

The pole handler attachment includes a base frame that is pivotally attached to an arm of an earth moving machine for pivotal movement about a transverse horizontal axis. A trunnion is fixed to the base frame. A sleeve is journaled on the trunnion for pivotal movement about a trunnion axis that is normal to the transverse horizontal axis. A fixed clamp assembly is fixed to the sleeve. A movable clamp assembly is pivotally attached to the sleeve. A clamp cylinder pivots the movable clamp assembly to hold a pole against first and second clamp surfaces on the fixed clamp assembly. The first clamp surface is perpendicular to the second clamp surface. A tilt linear actuator pivots the sleeve on the trunnion.

17 Claims, 4 Drawing Sheets

POLE HANDLER ATTACHMENT

TECHNICAL FIELD

The invention is in an attachment, for small loaders, that can grip a long pole, lift the pole, move the pole between a horizontal position and a vertical position and move the pole vertically while it is in a vertical position.

BACKGROUND OF THE INVENTION

Buildings commonly referred to as pole barns are used on farms and in other locations for storage buildings as well as for enclosed workspace. These buildings are constructed using long poles with a lower end embedded in the ground. The poles generally have a square or rectangular cross section. Normal cross section sizes are 4 inches by 4 inches, 4 inches by 6 inches, or 6 inches by 6 inches. The length of the poles vary from about 14 feet to well over 20 feet. The poles are inserted into holes bored in the ground. Normally the holes are sufficiently deep to place the bottom of each pole on soil that does not freeze in the winter. Generally the holes for the poles are 4 to 6 feet deep. Buildings that are used for storing farm machinery such as grain harvesters, require 12 feet or so of vertical space plus space for an overhead door. For many such buildings the poles are 18 to 24 feet long. The walls are constructed by attaching horizontal beams to the poles. Sheet metal panels are attached to the beams to form side walls. Roof trusses are supported by the poles. Purlins and sheet metal panels are attached to the trusses to completely enclose the interior space.

The poles that are used for pole barns are treated with wood preservatives to reduce rot and insect damage. The preservatives penetrate into the wood and may increase the weight of the poles somewhat. A 4 inch by 4 inch pole 24 feet long can easily be lifted and moved manually by two people. Such a pole can most likely be lifted by one person but is somewhat difficult to move around due to its length. It is also difficult to manually move such a pole to a vertical position due to the extended distance between the center of gravity of the pole and the upper end of the pole from the lower end of the pole where it can be held by an individual. Once a 24 foot wood pole is in a vertical position it can be difficult to manually hold the pole in a vertical position. Lowering a pole 8 feet long into a small diameter hole 4 feet or so deep is difficult if the pole cannot be easily held in one hand.

Machines are available for handling logs and utility poles. These machines are usually large and expensive units that are capable of moving large diameter logs and utility poles. Some of the machines can move multiple poles simultaneously.

Logs are severed from their roots where they grew and placed horizontally on the ground. Once logs are in a horizontal position, they often remain generally horizontal for storage, transport and for sawing into lumber. Machines for handling logs generally do not require the capability of moving a log from a horizontal position to a vertical position.

Logs are initially covered by bark. The bark provides protection for the underlying wood. Grapples can, as a result of the protection provided by the bark, apply substantial gripping force on a log. Utility poles have rough outer surfaces and do not require flat surfaces for the attachment of wall supports or other structure. As a result utility poles can generally be handled by grapples with a minimum number of grasping arms that squeeze their outer surface.

Lumber on the other hand must be handled with some care to prevent damage to flat surfaces.

BACKGROUND OF THE INVENTION

The pole handler attachment has a base frame that is adapted to be pivotally attached to a boom of an earth moving tractor for pivotal movement about a transverse horizontal axis. A trunnion is fixed to the base frame, extends forward from the base frame and has a trunnion axis that is perpendicular to the transverse horizontal axis. The trunnion axis is horizontal when the base frame is in a vertical position. A sleeve is telescopically received on the trunnion and axially retained on the trunnion. A fixed clamp assembly is secured to the sleeve and has a first pole clamp member and a second pole clamp member that cooperate to position one pole in a position that is generally transverse to the trunnion axis. A movable clamp assembly is pivotally attached to the sleeve for pivotal movement about a hinge axis that is perpendicular to the trunnion axis. A hydraulic clamping cylinder is pivotally attached to the sleeve and to the movable clamp assembly. The clamping cylinder is operable to pivot the movable clamp assembly about the hinge axis, and move the third pole clamp member toward the first pole clamp member and the second pole clamp member. A tilt hydraulic cylinder pivotally connected to the base frame and to the sleeve is operable to pivot the sleeve about the trunnion axis to move one pole held by the fixed clamp assembly and the movable clamp assembly between a horizontal position and a vertical position when the trunnion axis is horizontal.

DESCRIPTION OF THE DRAWINGS

The presently preferred embodiment of the invention is disclosed in the following description and in the accompanying drawings, wherein.

DESCRIPTION OF THE PREFERRED EMBODIMENT

Figure 1:
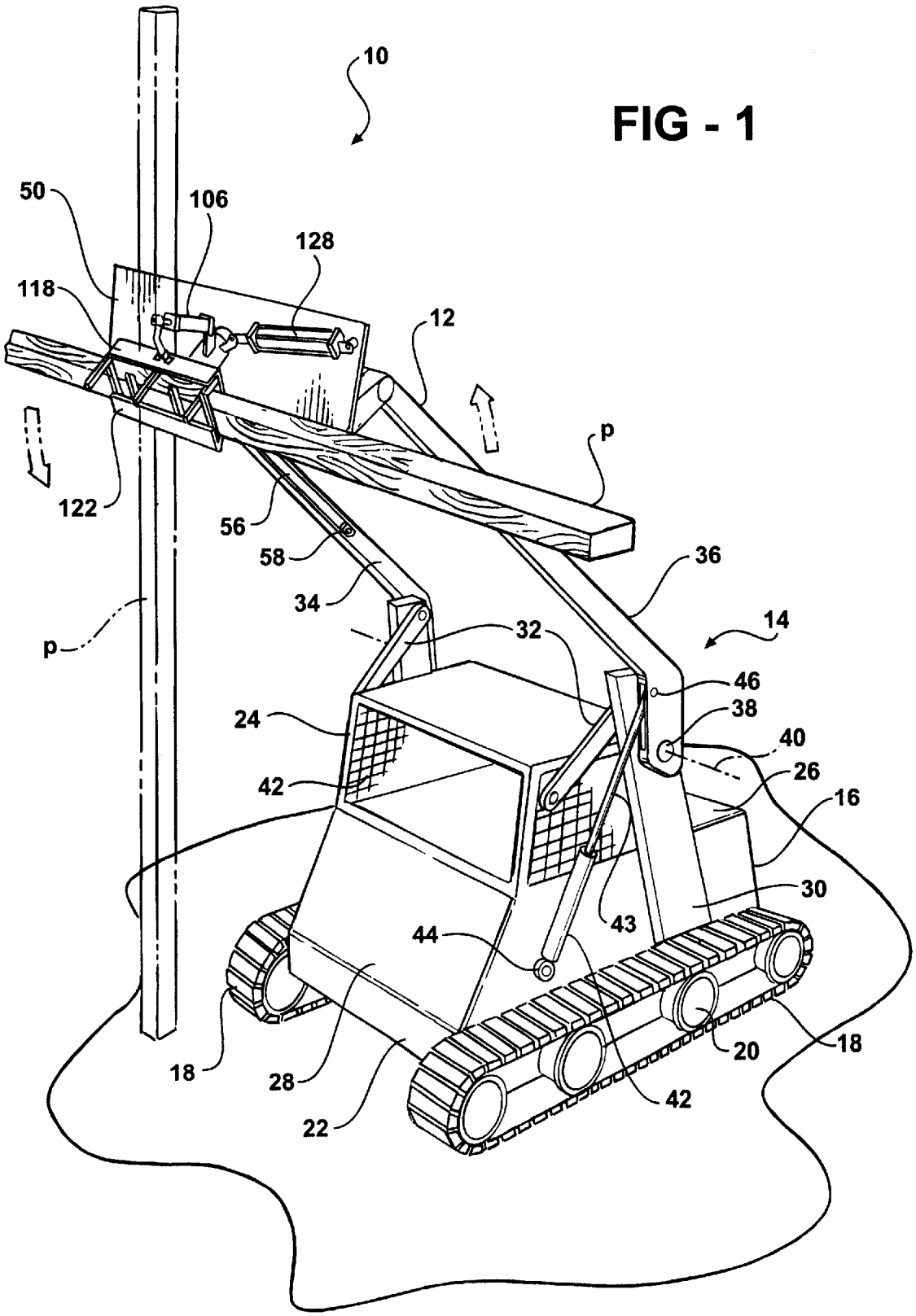
FIG. 1 is a perspective view of a small tractor with a loader attachment and pole handler attachment mounted on a loader boom of the loader attachment.

The pole handler attachment 10, as shown in FIG. 1, is mounted on the boom 12 of a loader attachment 14. The loader attachment 14 is mounted on a small tractor 16. The tractor 16, as shown, is a small skid steer tractor with a continues track 18 trained around wheels 20 on each side. Skid steer tractors 16 generally have 2 or more driven wheels on each side with rubber tires. Tracks 18 are available that can be trained around the rubber tires to provide additional flotation if desired. The loader attachment can also be mounted on a conventional crawler tractor or on a wheel tractor with a pair of steered wheels and at least two driven wheels.

Skid steer tractor 16 and wheel tractors with relatively small engines are inexpensive compared to tractors with large engines. Due to their low cost and a variety of attachments that are available, it is acceptable to keep one skid steer tractor on a construction site during construction.

Large tractors and machines are too expensive to keep on a construction site except when they are required. A medium sized excavator for example could lift a 24 foot pole by its upper end and then lower the pole vertically into a small diameter hole in the ground. Unfortunately, medium sized excavators and even medium and large wheel tractors are too expensive to let set at a construction site when they are not required and in use.

The tractor 16 has a frame 22 that supports a operator's compartment 24 and a rear engine compartment 26 that houses an engine. The panel 28 is open for ingress and egress to and from the operator's compartment 24. A loader mast 30 is integral with the frame 22 and is reinforced by braces 32 that have their forward ends secured to a roll over cage that forms the operator's compartment 24.

The right arm 34 and the left arm 36 of the loader boom 12 are pivotally attached to the loader mast 30 by pins 38, one of which is shown, for pivotal movement about a transverse horizontal axis 40. A pair of hydraulic cylinders 42 have head ends each of which is connected to the frame 22 by a pivot pin 44. Rod ends 43 of hydraulic cylinders 42 are connected to the boom 12 by pins 46. One pin 46 passes through the right arm 34 and the other pin passes through the left arm 36. Extension of the hydraulic cylinders 42 pivots the boom 12 about the axis 40 of pins 38 and raises the forward ends of the arms 34 and 36. Retraction of the hydraulic cylinder 42 lowers the forward ends of the arms 34 and 36. The flow of hydraulic fluid to and from the cylinders 42 is controlled by controls in the operator's compartment 24.

Figure 3:
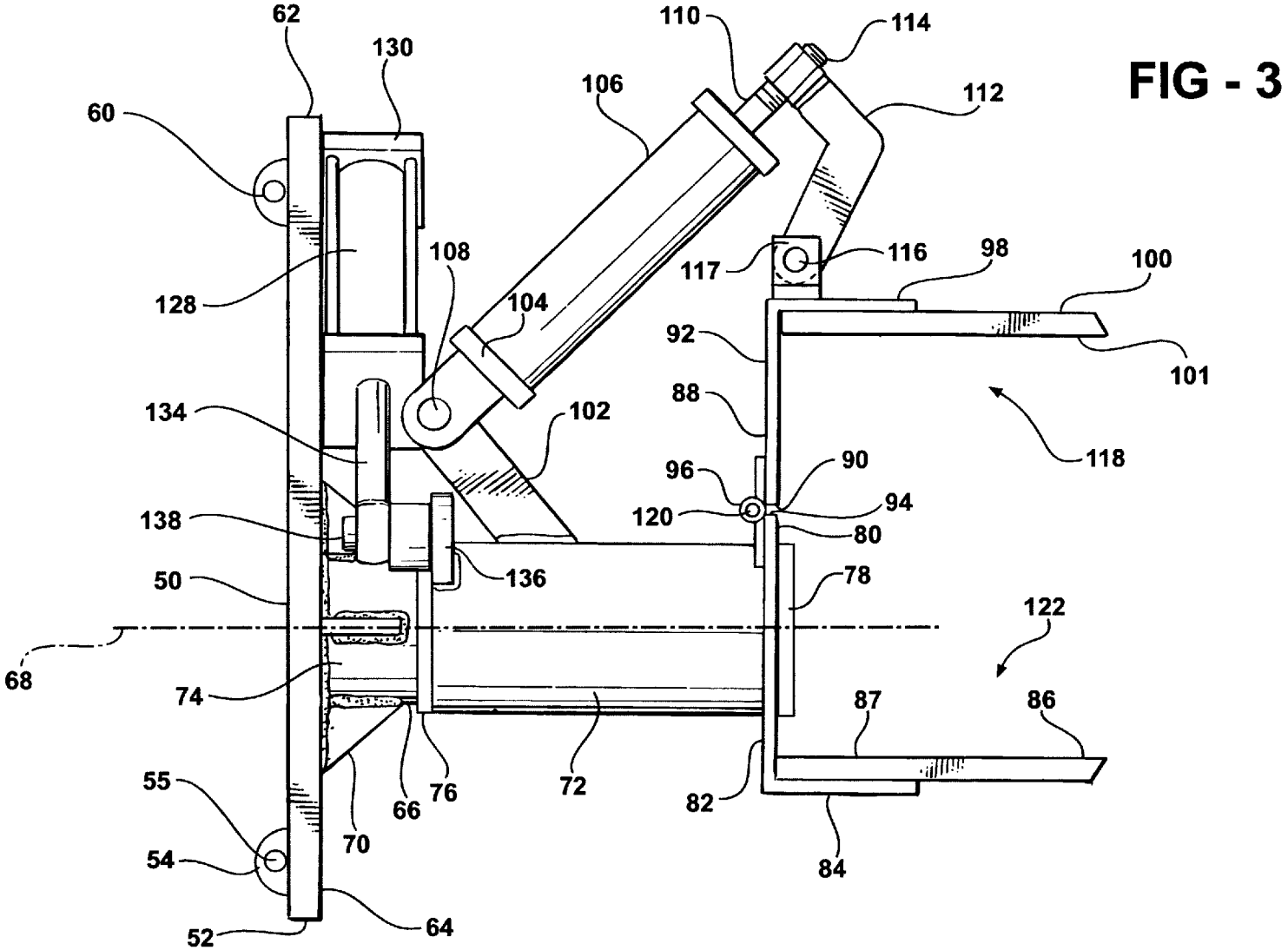
FIG. 3 is a side elevational view of the pole handler attachment.

The pole handler attachment 10 has an attachment base plate 50 or frame. The base frame 50 is shown as a flat plate but can have other shapes. The lower edge 52 of the base plate 50 is pivotally attached to the forward ends of the boom 12 by a pair of pivot pins 54. The pins 54 provide a transverse horizontal axis 55. A pair of hydraulic cylinders 56 have their head ends connected to the right boom 34 or to the left boom 36 by pins 58. The rods ends of the hydraulic cylinders 56 are pivotally attached to the base plate 50 by pins 60 near the upper edge 62. Extension of the hydraulic cylinders 56 pivots the plate 50 clockwise about the pins 54 as shown in FIG. 3. Retraction of the hydraulic cylinders 56 pivots the plate 50 counterclockwise about the pins 54. Extension of the cylinders 56 moves the front face 64 of the plate 50 from a vertical position as shown in FIG. 3 to a horizontal position and on a few degrees to a position in which the front face faces downward and rearward. Retraction of the cylinders 56 moves the front face 64, from the position shown in FIG. 3, a few degrees to a position in which the front face faces upward and forward. The total angular movement varies somewhat from one manufacturer of loaders to another manufacturer. The total angular movement of the plate 50 provided by the loader of one manufacturer is 134°.

The pivot pins 54 and 60, as shown in FIG. 3, are one system for connecting the base plate 50 to the boom 12. Some manufacturers employ a quick coupler system that reduces the time to switch from one attachment to another attachment. With some of the quick coupler systems it is possible to remove one attachment and attach a different tool without leaving the operator's compartment 24.

A trunnion 66 with a trunnion axis 68 is fixed to the base plate 50. The trunnion axis 68 is perpendicular to the front face 64 of the base plate 50. The base plate or frame 50 has a frame axis that is perpendicular to the trunnion axis 68 and that is a vertical axis of the base frame 50. As shown in the drawing figures, the trunnion 66 is a tubular member. Four gussets 70 are welded to the base plate 50 and to the trunnion 66 to strengthen the joint between the base plate and the trunnion.

A sleeve 72 is journaled on the outer surface 74 of the trunnion 66. A rear ring 76 and a front ring 78 are fastened to the trunnion 66 to axially fix the sleeve 72 relative to the trunnion axis 68 while leaving the sleeve 72 free to rotate. The rings 76 and 78 are preferably attached to the trunnion 66 by threaded fasteners. The rear ring 76 could be permanently attached to the trunnion 66 if desired. The front ring 78 should be removable to permit removal of the sleeve 72 for a replacement, repair or service.

A first elongated L-shaped member 80 is fixed to the forward end of the sleeve 72. A long leg 82 of the angle member 80 is perpendicular to and intersects the trunnion axis 68. A short leg 84 of the L-shaped angled member 80 is parallel to the trunnion axis 68 and does not intersect the trunnion axis. Four tines 86 are fixed to the short leg 84 in spaced apart positions parallel to the trunnion axis 68 and extend forward from the long leg 82. The tines 86 have coplanar pole contact clamp surfaces 87. The four tines 86 could however be replaced by one elongated plate member.

A second elongated L-shaped member 88 has a free edge 90 of its long leg 92 connected to a free edge 94 of the long leg 82 of the first L-shaped member 80 by a panel hinge 96. A short leg 98 of the L-shaped member 88 is perpendicular to the long leg 92. The three spaced apart tines 100 are fixed to the short leg 98. The tines 100 are parallel to the short leg and to each other, arid-perpendicular to the long leg 92. The tines have coplanar pole engaging clamp surfaces 101.

Figure 2:
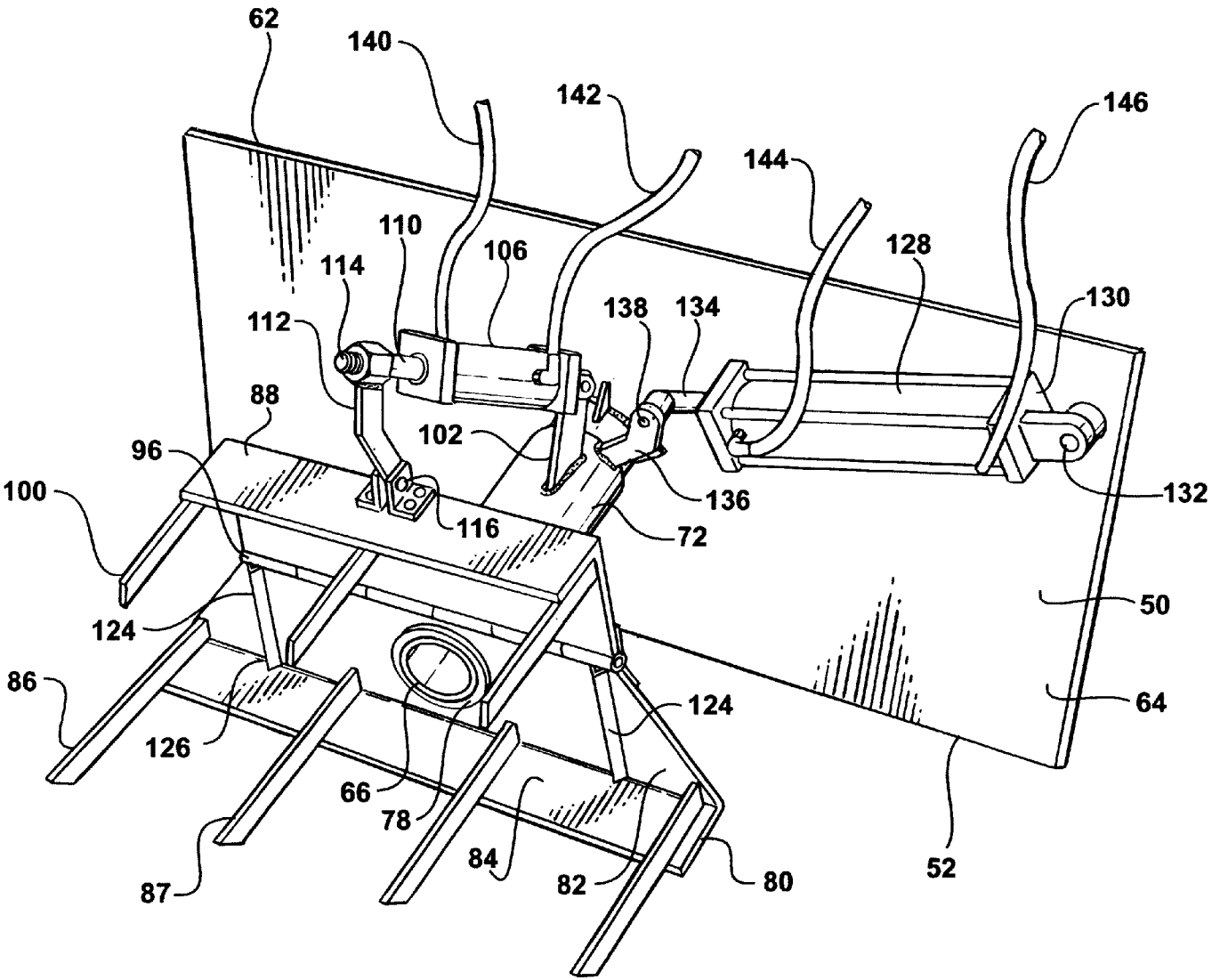
FIG. 2 is a perspective view of a pole handler attachment.
Figure 4:
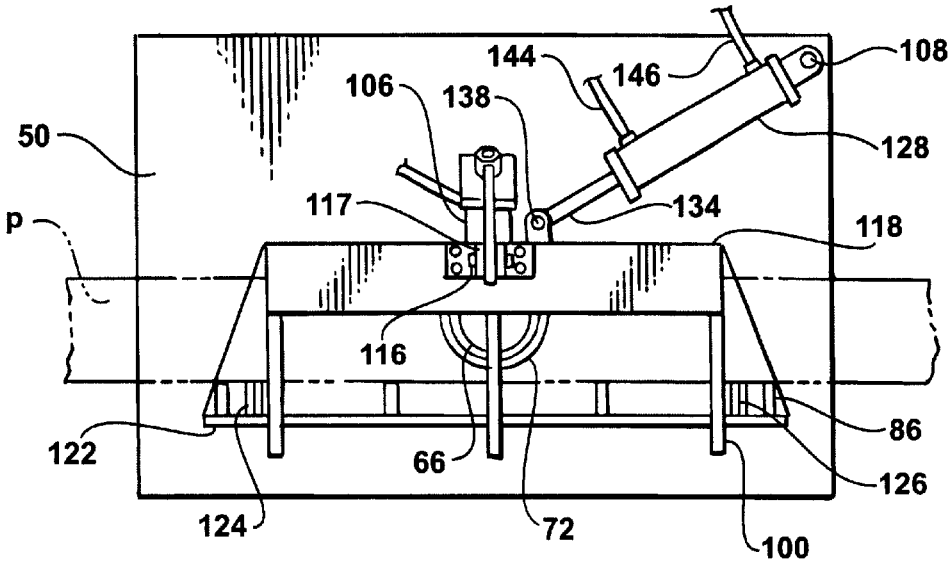
FIG. 4 is a front elevational view of the pole handler with a pole held in a horizontal position.
Figure 5:
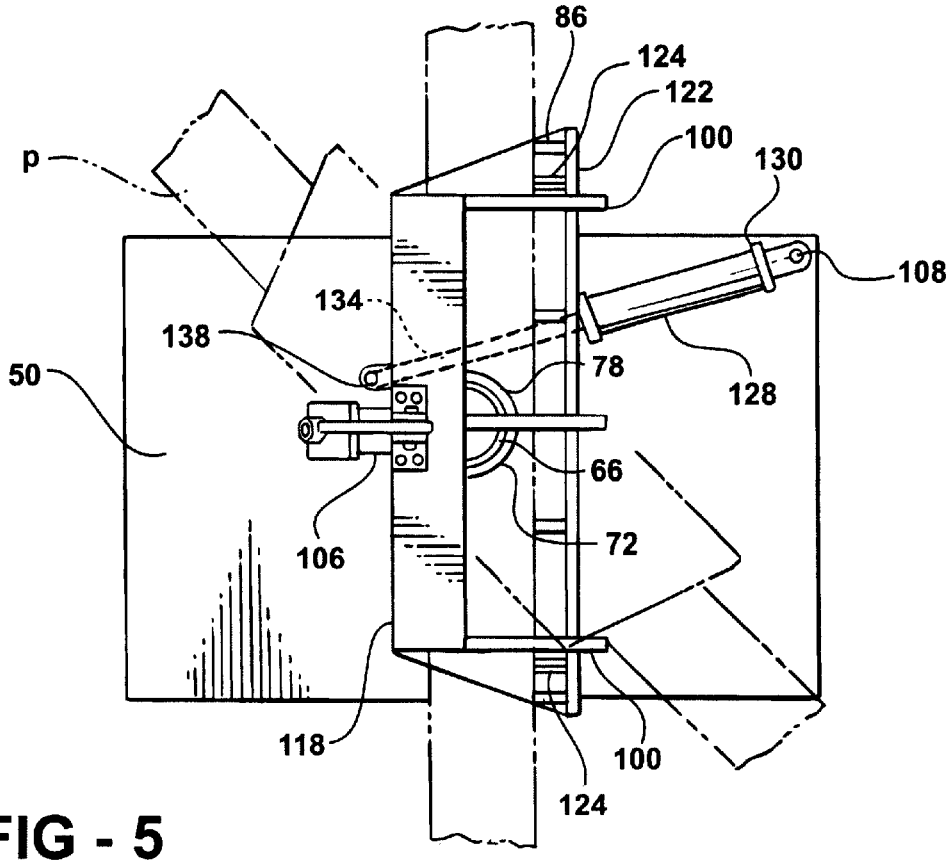
FIG. 5 is a view similar to FIG. 4 with a pole in a vertical position and in a position between vertical and horizontal.

A post 102 is welded to the sleeve 72 and extends radially outward from the sleeve 72 and the trunnion axis 68. The head end 104 of a hydraulic clamping cylinder 106 is pivotally connected to a free end of the post 102 by a pivot pin 108. The rod 110 of the clamping cylinder 106 is attached to an extension arm 112. The extension arm 112 is secured to the rod 110 by threads 114. The free end of the extension arm 112 is radially spaced from the rod 110, axially spaced from the threads 114 toward the head end 104, and is pivotally attached to the second L-shaped support member 88 by clamp pivot pin 116. The clamp pivot pin 116 also passes through a pair of spaced apart ears 117 secured to the short leg 98. Retraction of the clamping cylinder 106 pivots the movable clamp assembly 118 counterclockwise about the hinge axis 120 of the piano hinge 96 and toward clamp open position as shown in FIG. 3. Fixed clamp assembly 122 is fixed relative to the sleeve 72 as described above. Extension of the clamping cylinder 106 pivots the movable clamp assembly 118 and the tines 100 toward the tines 86 of the fixed clamp assembly 122 to hold a pole P as shown in FIGS. 1, 4 and 5. Angle iron members 124 can be welded to the front side of the long leg 82 of the L-shaped member 80 as shown in FIG. 2. The angle iron members 124 have a sharp edge 126 that tends to grip a pole P and prevent a pole from sliding relative to the tines 86 and 100 when the pole is held in a vertical position. The angle iron members 124 also hold a pole P out of contact with the forward end of the trunnion 66. If desired, more than two angle iron members 124 can be used. The elongated L-shaped member 80 is reinforced and strengthened by the angle iron members 124. Brace members (not shown) with forward ends welded to the L-shaped angle member 80 and rear ends welded to the rear of the tubular sleeve 72 can be provided if desired to further strengthen the fixed clamp assembly 122.

The extension arm 112 described above permits the use of a hydraulic clamping cylinder 106 with an increased length and an increased stroke in a confined space. The increased stroke is required to obtain the full range of motion of the movable clamp assembly 118 about the hinge axis 120. The full range of motion of the movable clamp assembly 118 is required when handling poles P with a relatively small diameter or thickness.

A tilt hydraulic cylinder 128 has a head end 130 that is pivotally attached to the base plate 50 by a pivot pin 132. The rod 134 of hydraulic cylinder 128 is pivotally connected to a post 136 by a pivot pin 138. The post 136 is welded to the sleeve 72. Extension of the hydraulic cylinder 128 and the rod 134 rotates the sleeve 72 counterclockwise on the trunnion 66 as shown in FIG. 2. Retraction of the hydraulic cylinder 128 and the rod 134 rotates the sleeve 72 clockwise about the trunnion axis 68 as shown in FIG. 2. A link that offsets the cylinder rod 134 to one side of the pivot pin 138 can be used if desired. Such a link would be similar to the extension arm 112 on the rod 110 as described above. The cylinder 128 can rotate the sleeve 72 about 120° without difficulty. The cylinder 128, with its direct connection to the post 136, would lock at both ends if an attempt was made to rotate the sleeve 180°. However, an attempt to rotate the sleeve 72 by extending the rod 134 a little further than shown in FIG. 5 could result in the rod 134 contacting the trunnion 66 or a gusset 70. Linkages are known which would permit a linear actuator to rotate the sleeve 72 more than 180° if necessary.

The linear actuator 128 for rotating the sleeve 72 can provide precise and positive control of the sleeve in both directions with the proper valves and valve orifices to control fluid flow. Attempts to control rotation of a sleeve 72 with a rotary motor and a chain drive leaves the sleeve 72 free to oscillate a few degrees when the motor is stopped. This is due to the face that chain drives have at least some slack on the non-tensioned side of the drive chain. When you attempt to move the end of a pole P an inch or less by rotating a pole about trunnion axis 68 that is twelve feet, for example, from the pole end, the movement must be positive and precise. The linear actuator 128 and a hydraulic control system can provide the required precision.

During operation of the pole handler attachment, the hydraulic clamping cylinder 106 is retracted and the movable clamp assembly 118 is rotated about the hinge axis 120 to a raised and open position. The hydraulic cylinder 128 rotates the sleeve 72 to a position which places the forward tips of the tines 86 at an equal height relative to a surface supporting and a pole P in a generally horizontal position. The tractor 16 is moved up to the side of a generally horizontal pole P. The base plate 50 is lowered by the cylinders 42 and the tines 86 are tilted by the hydraulic cylinders 56 until the forward ends of the tines are below the pole P that is to be moved. The tractor 16 is then moved forward until the tines 86 are directly under the pole P. The tines 86 of the fixed clamp assembly 122 are then tilted upward by the cylinders 56 to lift the pole P and move the pole toward the long leg 82 and the angle iron members 124 of the fixed clamp assembly 122. The hydraulic cylinder 106 is then extended to pivot the movable clamp assembly 118 and force the pole P toward the tines 86 and the angle iron members 124. Once the movable clamp assembly 118 is holding the pole P in a fixed position against the edges 126 of the angle iron members 124 and a clamp surface 87 of the tines 86, the pole is ready to be transported by the tractor 16 to a location for erection. During this movement, the operator of the tractor 16 must watch for obstructions and raise, lower, or tilt the pole P as required.

The cylinders 42 are extended to raise the pole handling attachment 10, and the cylinders 56 are extended or retracted to keep the trunnion 66 and the trunnion axis 68 horizontal. The cylinder 128 is extended to rotate the sleeve 72 about the trunnion axis 68 and move pole P to a vertical position. The tractor 16 is then moved as required to align the pole P with a bore in the ground. Once the pole P is aligned with the bore in the ground, the cylinders 42 are retracted to lower the pole into the bore. As the pole is lowered, the tractor 16 must be moved backwards and the cylinders 56 must be retracted to keep the pole P vertical and aligned with the bore in the ground due to pivotal movement of the boom 12 about the pins 338 and the transverse horizontal axis 40. After the pole handler attachment 10 is lowered to the height of the pins 38, the tractor 16 may need to move forward as the pole is lowered further to keep the pole centered in the bore in the ground. Continued retraction of the cylinders 56 will be required to keep the pole P vertical as the cylinders 42 are retracted. Upon the pole P reaching the bottom of the bore in the ground, the pole handler attachment 10 can hold the pole in a vertical position while the remainder of the bore in the ground is filled and tamped if desired. The clamping cylinder 106 is retracted to move the movable clamp assembly 18 to an open position and release the pole P. After the pole P is released, the tractor 16 can be moved to collect another pole or to an out of service area.

The boom 12 on the skid steer loader 16 or other small tractor can only pivot upward to about 10 feet. As a result, the pole handler attachment 10, when handling poles longer than 18 feet will have to hold the pole to one side of the center. As a result, it may be necessary to manually load longer poles P onto the fixed clamp assembly 122. Poles that are laying flat on a paved surface may also require manual loading of the poles onto the fixed clamp assembly 122.

The base plate 50 as described above and shown in the drawing is a member employed to connect various attachments to loader attachments 14 on skid steer tractors 16. The base plate 50 can take other shapes than the shape shown in the drawings. Any frame member 50 that can support the trunnion 66 and the tilt hydraulic cylinder 128, and that can be attached to a beam that supports a bucket of some type may be suitable. Small wheels tractors with loaders are mentioned above. The pole handler attachment could also be attached to an excavator or to a back hoe by modifying the base plate 50.

The non-rotatable trunnion 66 and the sleeve 72 that is journaled on the trunnion 66 makes it possible to employ linear actuators such as hydraulic cylinders 106 and 128 and to connect the cylinders to a hydraulic fluid source by flexible hydraulic lines 140, 142, 144 and 146. The direct connection between the control valves and standard double acting hydraulic cylinders 106 and 128 simplifies the construction, reduces cost and reduces maintenance and repair time.

The disclosed embodiment is representative of a presently preferred form of the invention, but is intended to be illustrative rather than definitive thereof. The invention is defined in the claims.

What is claimed is:

1. A pole handler attachment comprising:

a base frame adapted to be pivotally attached to the boom of an earth mover for pivotal movement about a transverse horizontal axis;

a trunnion fixed to the base frame, extending forward from the base frame and having a trunnion axis that is perpendicular to the transverse horizontal axis and that is horizontal when the base frame is in a vertical position;

a sleeve telescopically received on the trunnion and axially retained on the trunnion;

a fixed clamp assembly secured to the sleeve and having a first pole clamp member and a second pole clamp member that cooperates with the first pole clamp member to position one pole in a position generally transverse to the trunnion axis;

a movable clamp assembly pivotally attached to the sleeve for pivotal movement about a hinge axis that is perpendicular to the trunnion axis and having at least one third pole clamp member;

a hydraulic clamping cylinder pivotally attached to the sleeve and to the movable clamp assembly and operable to pivot the movable clamp assembly about the hinge axis, and move the third pole clamp member toward the first pole clamp member and the second pole clamp member;

a tilt hydraulic cylinder pivotally connected to the base frame and to the sleeve and operable to pivot the sleeve about the trunnion axis to move one pole held by the fixed clamp assembly and the movable clamp assembly between a horizontal position and a vertical position when the trunnion axis is horizontal.

2. A pole handler attachment as set forth in claim 1 wherein the first pole clamp member has a first pole clamp surface that is parallel to the trunnion axis and the second pole clamp member has a second pole clamp surface that is perpendicular to the first pole clamp surface.

3. A pole handler attachment as set forth in claim 2 wherein the second pole clamp surface is a small area contact surface that resists sliding between poles and the fixed clamp assembly in a direction perpendicular to the trunnion axis.

4. A pole handler attachment as set forth in claim 1 wherein the fixed clamp assembly includes a plurality of first pole clamp members each of which has a first pole clamp surface.

5. A pole handler attachment, as set forth in claim 4, wherein the first pole clamp surfaces on the plurality of first pole clamp members are coplanar.

6. A pole handler attachment, as set forth in claim 1, wherein the fixed clamp assembly includes a plurality of angle iron members with sharp edges that engage poles.

7. A pole handler attachment as set forth in claim 1, wherein the hydraulic clamping cylinder can pivot the movable clamp assembly at least 90° about the hinge axis.

8. A pole handler attachment, as set forth in claim 1, wherein the tilt hydraulic cylinder pivots the sleeve about the trunnion axis no more than 180°.

9. A pole handler attachment, as set forth in claim 1, wherein the tilt hydraulic cylinder pivots the sleeve about the trunnion axis at least 90°.

10. A pole handler attachment comprising:

a base frame adapted to be pivotally attached to the boom of an earth mover for pivotal movement about a transverse horizontal axis;

a trunnion fixed to the base frame, extending forward from the base frame and having a trunnion axis that is perpendicular to the transverse horizontal axis and that is horizontal when the base frame is in a vertical position;

a sleeve telescopically received on the trunnion and axially retained on the trunnion;

a fixed clamp assembly secured to the sleeve and having a first pole clamp member with a plurality of spaced apart fixed tines that are parallel to the trunnion axis, a first pole clamp surface on each of the plurality of spaced apart fixed tines and wherein the first pole clamp surfaces are coplanar, and a second pole clamp member with at least one second pole clamp surface that is perpendicular to the first pole clamp surfaces and fixed relative to the first pole clamp surfaces, a movable clamp assembly pivotally attached to the sleeve for pivotal movement about a hinge axis that is perpendicular to the trunnion axis and having at least two movable clamp tines each of which has a third pole clamp surface and wherein the third pole clamp surfaces are coplanar;

a hydraulic clamping cylinder pivotally attached to the sleeve and to the movable clamp assembly and operable to pivot the movable clamp assembly about the hinge axis, and move the third pole clamp surfaces toward the first pole clamp surfaces and the at least one second pole clamp surface;

a tilt hydraulic cylinder pivotally connected to the base frame and to the sleeve and operable to pivot the sleeve about the trunnion axis to move one pole held by the fixed clamp assembly and the movable clamp assembly between a horizontal position and a vertical position when the trunnion axis is horizontal.

11. A pole handler attachment as set forth in claim 10 wherein the second pole clamp surface is a small area contact surface that resists sliding between poles and the fixed clamp assembly in a direction perpendicular to the trunnion axis.

12. A pole handler attachment, as set forth in claim 10, wherein the fixed clamp assembly includes a plurality of angle iron members with sharp edges that engage poles.

13. A pole handler attachment as set forth in claim 10, wherein the hydraulic clamping cylinder can pivot the movable clamp assembly at least 90° about the hinge axis.

14. A pole handler attachment, as set forth in claim 10, wherein the tilt hydraulic cylinder pivots the sleeve about the trunnion axis no more than 180°.

15. A pole handler attachment, as set forth in claim 10, wherein the tilt hydraulic cylinder pivots the sleeve about the trunnion axis at least 90°.

16. A method of erecting poles for a pole building employing a pole handler attachment on a tractor mounted loader comprising:

positioning a first clamp assembly that is fixed relative to a sleeve of said pole handler attachment, under a central portion of an elongated pole with a rectangular cross section;

pivoting a second clamp assembly of said pole handler attachment relative to the first clamp assembly and to the sleeve;

clamping the elongated pole between a first surface on the first clamp assembly, a second clamp surface on the first clamp assembly, and a third clamp surface on the second clamp assembly;

lifting the elongated pole;

rotating the elongated pole from a horizontal position to a vertical position by rotating the sleeve;

aligning the elongated pole with a vertical bore;

lowering a bottom end of the elongated pole into a vertical bore while maintaining the pole in a vertical position and in alignment with the vertical bore; and unclamping the elongate pole.

17. A method of erecting poles as set forth in claim 16 wherein the elongated pole is maintained in a vertical position and in alignment with the vertical bore by pivoting the sleeve of the pole handler attachment and by moving the tractor horizontally.

* * * * *